US007204696B1

(12) United States Patent
Libby, II et al.

(10) Patent No.: US 7,204,696 B1
(45) Date of Patent: Apr. 17, 2007

(54) DUPLEX RECEPTACLE

(75) Inventors: Charles A. Libby, II, Montoursville, PA (US); Robert A. Libby, Williamsport, PA (US)

(73) Assignee: Aslan Industries, Corporation, Montoursville, PA (US)

( * ) Notice: Subject to any disclaimer, the term of this patent is extended or adjusted under 35 U.S.C. 154(b) by 0 days.

(21) Appl. No.: 11/542,441

(22) Filed: Oct. 3, 2006

(51) Int. Cl.
*H01R 29/00* (2006.01)

(52) U.S. Cl. ..... 439/52; 439/189; 200/51 R; 200/51.03

(58) Field of Classification Search ..... 439/52, 439/188, 189, 535, 418; 200/51 R, 51.03
See application file for complete search history.

(56) References Cited

U.S. PATENT DOCUMENTS 3,673,361 A * 6/1972 Bulgin ..... 200/51.03
4,165,443 A * 8/1979 Figart et al.
4,485,282 A * 11/1984 Lee
4,701,134 A * 10/1987 Jones ..... 439/43
5,098,307 A * 3/1992 Francisco
5,261,825 A * 11/1993 Chaves ..... 439/52
5,306,157 A * 4/1994 Francisco
5,312,261 A * 5/1994 Burke et al. ..... 439/52
5,785,551 A * 7/1998 Libby

* cited by examiner

*Primary Examiner*—Hien Vu
(74) *Attorney, Agent, or Firm*—Thomas R. Shaffer

(57) ABSTRACT

This duplex receptacle will be factory installed in its own enclosure and sealed to provide safety and quick mounting. Both outlets can be constantly powered or one of the outlets can be wired for constant power and the other outlet controlled by a switch. Both applications can be performed by the internal bussing of the duplex receptacle and a cam within the receptacle housing. At installation, the installer will set the cam on the back of the receptacle according to the application desired.

7 Claims, 8 Drawing Sheets

DUPLEX RECEPTACLE WIRING DIAGRAM

FIG. 2.a. (PRIOR ART)
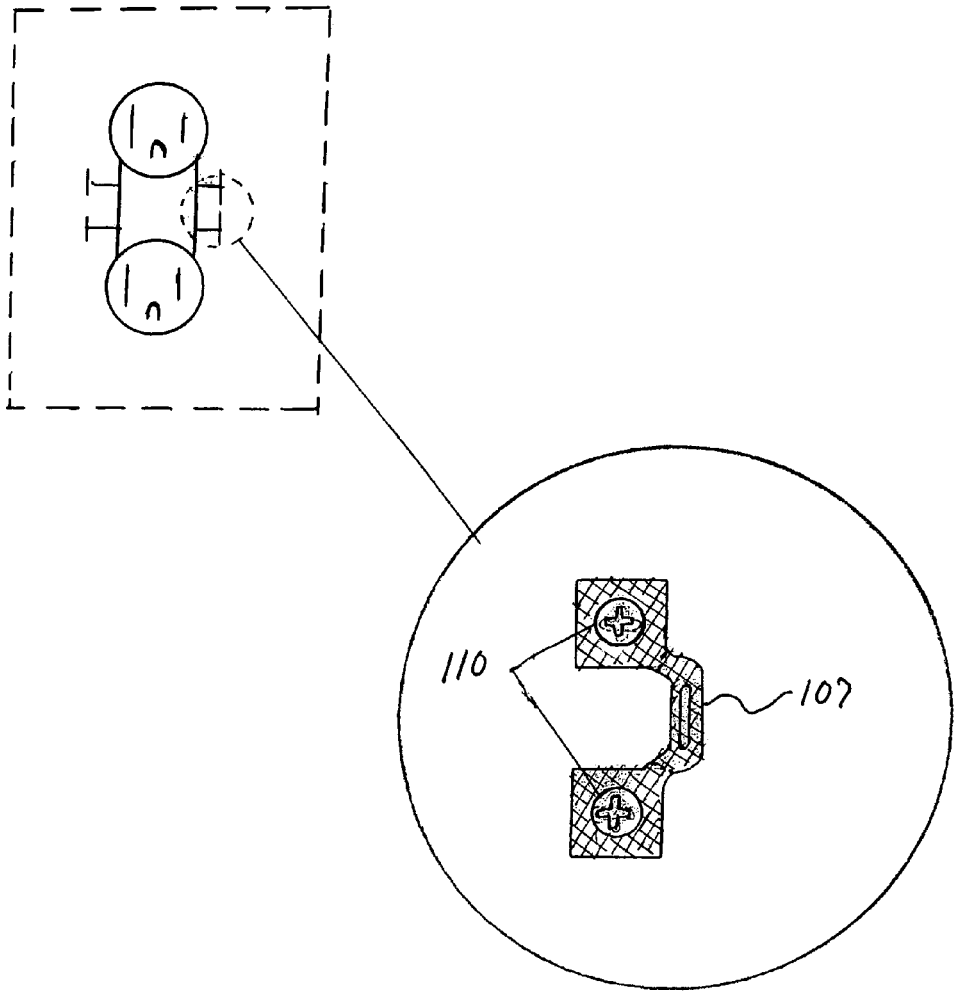

FIG. 7
Fig 7a
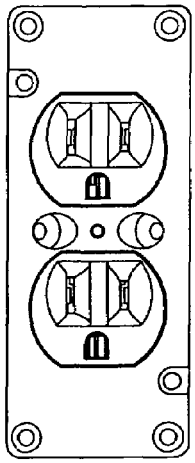
FRONT
Fig 7b
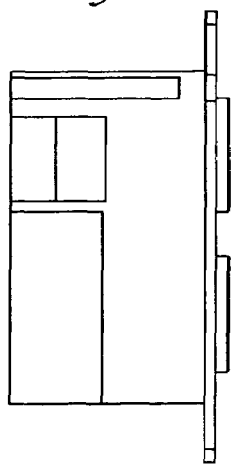
SIDE
Fig 7c
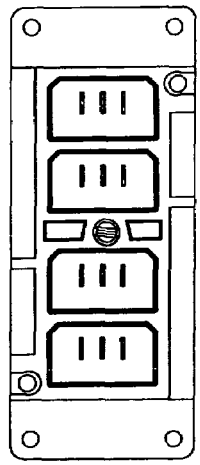
BACK
Fig 7d
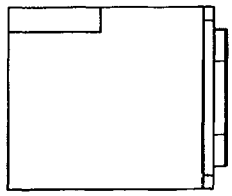
Fig 7e
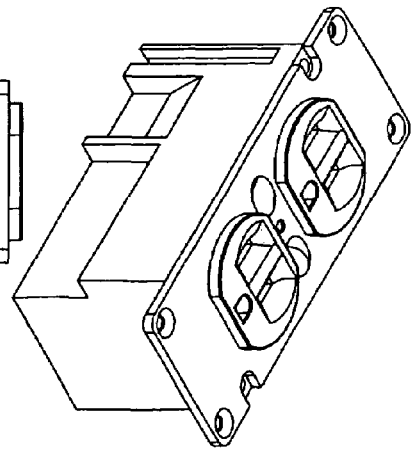

DUPLEX RECEPTACLE

BACKGROUND OF THE INVENTION

1. Field of the Invention

The present invention relates to a duplex receptacle for electric cable wiring. More specifically, it relates to a duplex receptacle provided in an enclosure which allows for a simplified installation of switched and non-switched outlets.

2. Description of the Prior Art

A duplex receptacle, also known as a convenience outlet, is an electrical wiring device that allows electrical current or power to be available at desirable locations. These locations being in residential homes, commercial buildings, or anywhere that you would need access to electrical power. Duplex, meaning two, explains that there are two outlets or receptacles in one. A duplex receptacle can be used in two different applications. The first and most widely used is simply to provide electrical current to appliances, electric powered motors, and anything that operates using electricity.

In FIG. 1 (prior art) both receptacles (200 & 201) are energized or powered from a power panel (100) and the wire connections are made to screw terminals (110). The second application illustrated in FIG. 2 (prior art), a duplex receptacle (200) can be wired in a branch circuit such that half of the receptacle, or one outlet (203), is always energized and the other is controlled by a switch (102). An example of this would be to control a floor or table lamp in a room from a wall switch where a ceiling light fixture would not be present. A typical application is often done in living rooms and some bedrooms. This type of wiring is accomplished by breaking the metal tab (107) on the duplex receptacle between the two screw terminals (110) when the receptacle is installed. See FIG. 2.*a* (prior art).

The current method of installing and wiring a duplex receptacle is time consuming and involved. The electrician has to supply a 2 conductor with ground, non-metallic cable or (Romex®), into an enclosure which is mounted to the wall, strip away the insulating jacket, separate the individual conductors, strip the insulation from each of the conductors, attach each conductor to the screw terminals on the receptacle, and then mount the receptacle to the box. Should the electrician want to install the receptacle so it can be used in a switched circuit as in FIG. 2, he would break off the link or (breakaway tab), that connects the two sets of terminals (110), FIG. 2*a*. Next the wires coming from the switch would be attached to one set of terminals and then connect another set of wires coming from the power panel to the other set of terminals on the receptacle. Should that circuit need to be converted back to using that receptacle as a duplex power outlet as in FIG. 1, the electrician would have to replace that receptacle or make a jumper (link) and attach it between the two sets of terminals and re-install the receptacle.

The concept of providing a modular system wherein male plugs would simply be inserted into corresponding female ports built into a prewired switch is suggested by Libby, U.S. Pat. No. 5,785,551. The Libby '551 patent teaches that it is desirable to reduce and simplify the number of steps required in wiring an electrical power distribution system and to make electrical connections without the need to strip the ends of the individual conductors in an electrical cable. FIGS. 1 through 10 show the typical manner in which the electrical wiring of a receptacle was accomplished in the past. FIGS. 11a–d and 12 of Libby '551 show and describe the use of a box into which male cable plugs are inserted into female connectors 46 provided in the box to simplify the wiring of the box. Other possible solutions to the problems relating to duplex receptacles are proposed in Francisco, U.S. Pat. No. 5,098,307 and Francisco, U.S. Pat. No. 5,306,157. In these patents, the use of a spring loaded with leg and a rotatable pin (or other means selectively connect selected bus bars or plates) are used to convert a constantly hot outlet to either an external switch or a secondary source of power. While these patents appear to provide some improvement over the prior art, the devices are overly complex and still require manual wiring of electrical conductors to various screw terminals on the receptacles. The present invention relates to a new and improved duplex receptacle which does not require any manual wiring in which can preferably be converted from one application to another from a location outside of a sealed enclosure.

SUMMARY OF THE INVENTION

The newly designed duplex receptacle of the present invention will eliminate the time of manually stripping away the insulated jacket and individual conductors by use of Q-CEB (Quick-Connect Electrical Box) connectors as described in Libby, U.S. Pat. No. 5,975,938. This duplex receptacle will be factory installed in its own enclosure and sealed to provide safety and quick mounting. Both applications can be performed by the internal bussing and a cam within the receptacle housing. At installation, the installer will set the cam on the back of the receptacle according to the application being applied described in directions included with every receptacle.

The present invention in its simplest form provides a duplex receptacle for electric cable wiring comprising: a) an enclosure having input ports and an output ports; b) a first electrical outlet; c) a second electrical outlet; d) a power bus extending in segments between an input port and an output port, said power bus having a first power bus segment connected to said first outlet and a second power bus segment connected to said second outlet; e) a return bus extending between an input port and an output port, said return bus connected to said first outlet and to said second outlet; f) a ground bus extending between an input port and an output port; and g) a cam having a cam arm, said cam movable between a first position and a second position wherein, in said first position, said arm does not contact said power bus and said first power bus segment is in electrical contact with said second power bus segment and in said second position, said arm contacts said power bus and cause said first power bus segment and a second power bus segment to be electrically separated.

The enclosure has an exterior and said input ports and said output ports are accessible from the exterior of the enclosure.

Preferably, input ports and said output ports each provide a separate and independent connection to said power bus, said return bus and said ground bus.

Preferably, four ports are provided on said enclosure with each of said ports capable of being connected to an electrical circuit and operating as one of an input port and an output port. Preferably, said power bus and said return bus each further comprise a longitudinally extending portion, four leg portions with one leg portion extending to each of said ports, and two neck portions with one neck portion extending to said first outlet and a second neck portion extending to said second outlet.

Preferably, said cam has a shaft adapted for rotation between said first position and said second position. Preferably, said shaft extends at least partially through an exterior of the enclosure and can be rotated between said first position and said second position from a location outside the enclosure.

Preferably, said enclosure is factory sealed and has an interior which is inaccessible to an installer.

BRIEF DESCRIPTION OF THE FIGURES

FIG. 2*a* is an enlarged view of a break-away tab provided on an existing prior art duplex receptacle.

FIGS. 7*a*–7*e*, respectively, are front, side, back, end and perspective views of the duplex receptacle of the present invention.

DETAILED DESCRIPTION OF THE PREFERRED EMBODIMENTS

The following descriptions, by way of drawings, will explain how setting the cam C1 can open or close the contacts on the bussing, thus allowing the two applications to be applied. Keep in mind that current travels in a complete circle or "loop". The electrical current comes from a power source, such as the power panel in a residential home through, as was mentioned, non-metallic cable (NMC). The cable has a ground wire, a black wire which is the hot wire and takes the current to the device, and the white wire, which is the neutral, this wire carries the current back to the source or power panel completing the "loop".

Figure 1:
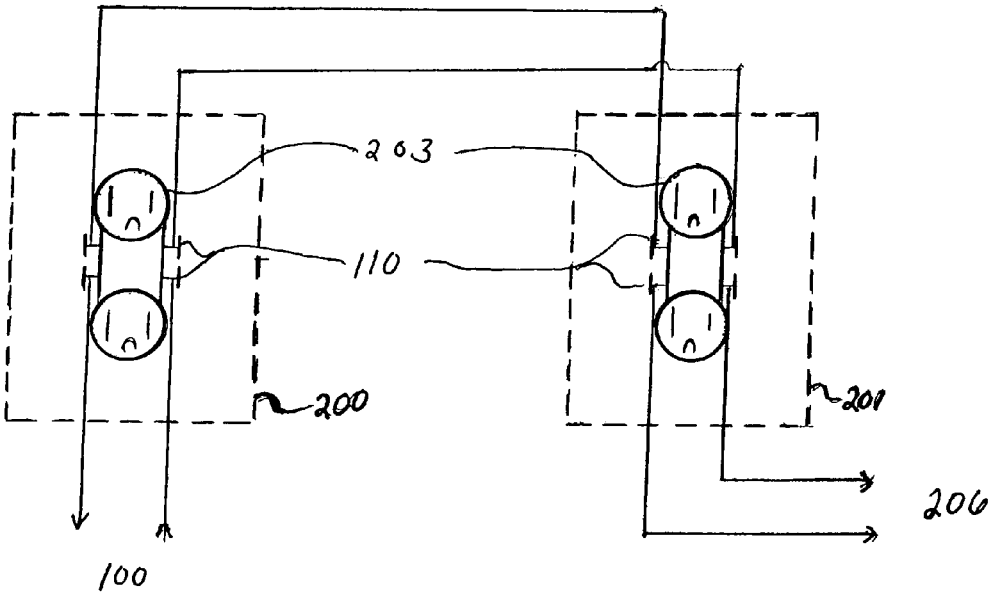
FIG. 1 (PRIOR ART)
FIG. 1 is a schematic diagram of a prior art circuit for existing duplex receptacles with two outlets constantly powered.
Figure 2:
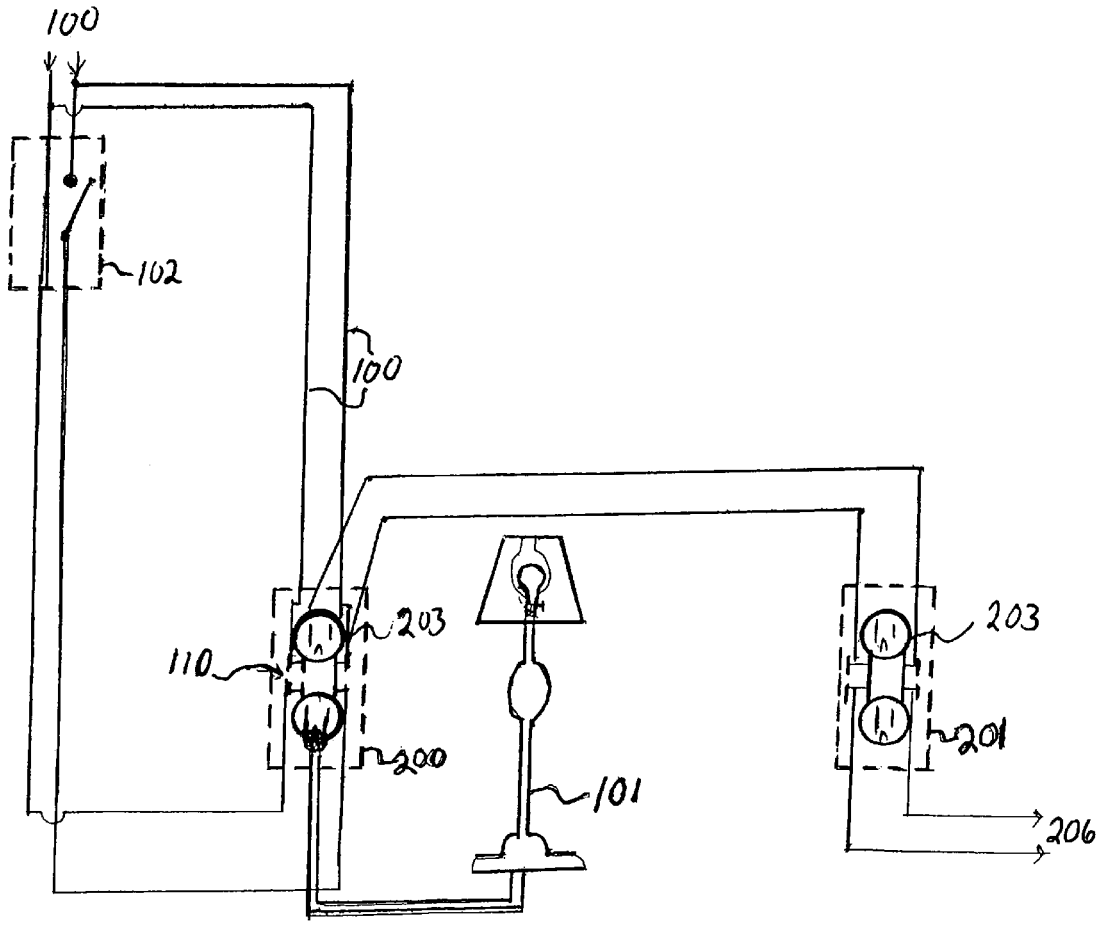
FIG. 2 (PRIOR ART)
FIG. 2 is a schematic diagram of a prior art circuit for existing duplex receptacles with one outlet constantly powered and one outlet controlled by a switch.
Figure 3:
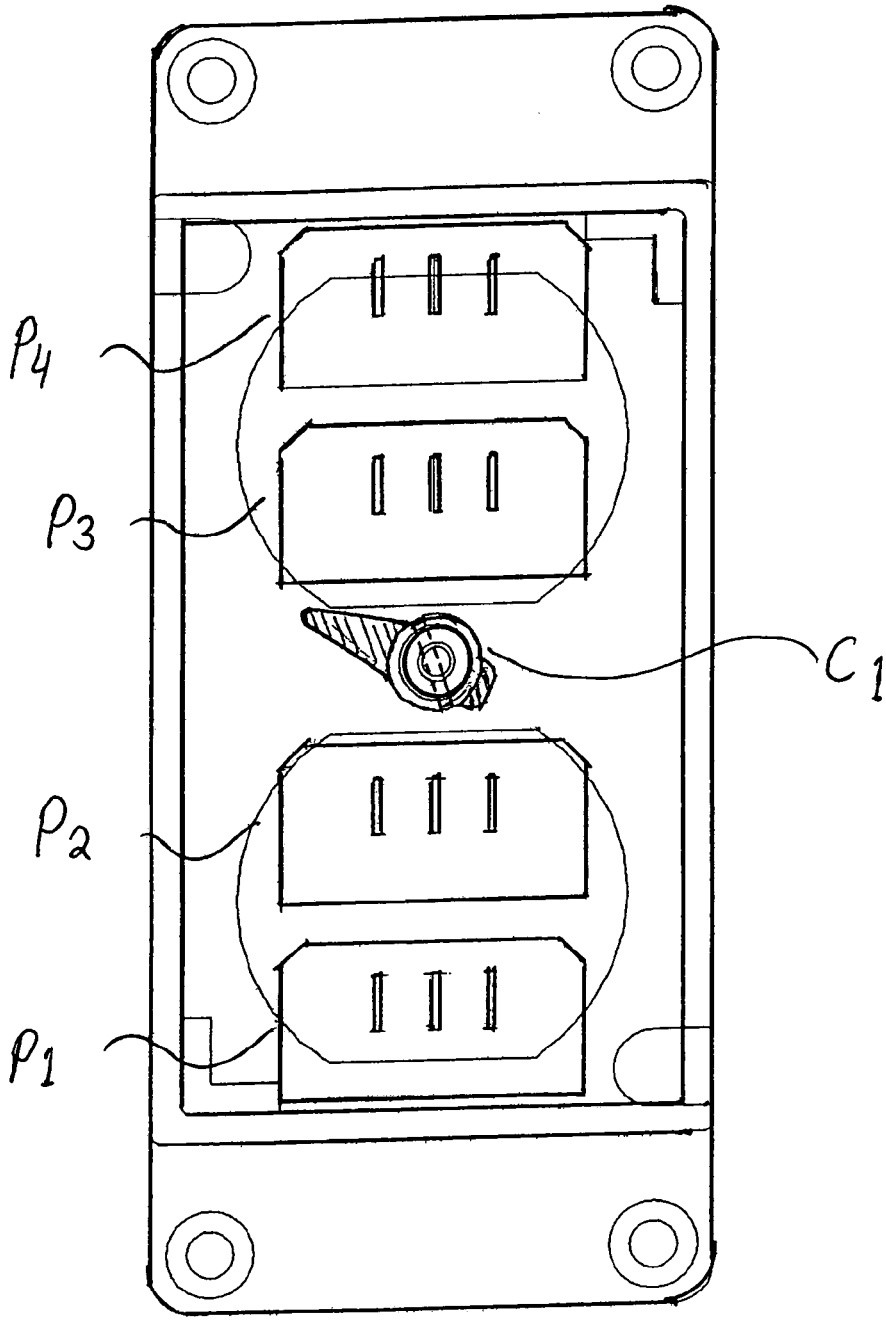
FIG. 3 is a rear plan view of the duplex receptacle of the present invention showing the ports and the cam.

We will first examine the overall duplex receptacle and its parts. FIGS. 1 and 2 show the schematic layout of the two different circuits in which a duplex receptacle can be wired. FIG. 3 shows the four ports, P1, P2, P3, and P4. These ports will accept the new Q-CEB connector which terminates the NMC (non-metallic cable) carrying the electric current or power to the receptacle and also carries the current back out of the device to the next receptacle or switch depending on the application being used. FIG. 3 also illustrates cam C1, incorporated in our receptacle that will allow the two applications to be performed. The cam C1 will function to open and close the bussing, replacing the step of "breaking the link" between the two terminals. The cam can be switched from the two positions, accessed from the back of the receptacle, by using a screw driver. The bussing demonstrated in FIGS. 4, 5, and 6, transfers the power from the ports to the first outlet O1 and second outlet O2.

Figure 4:
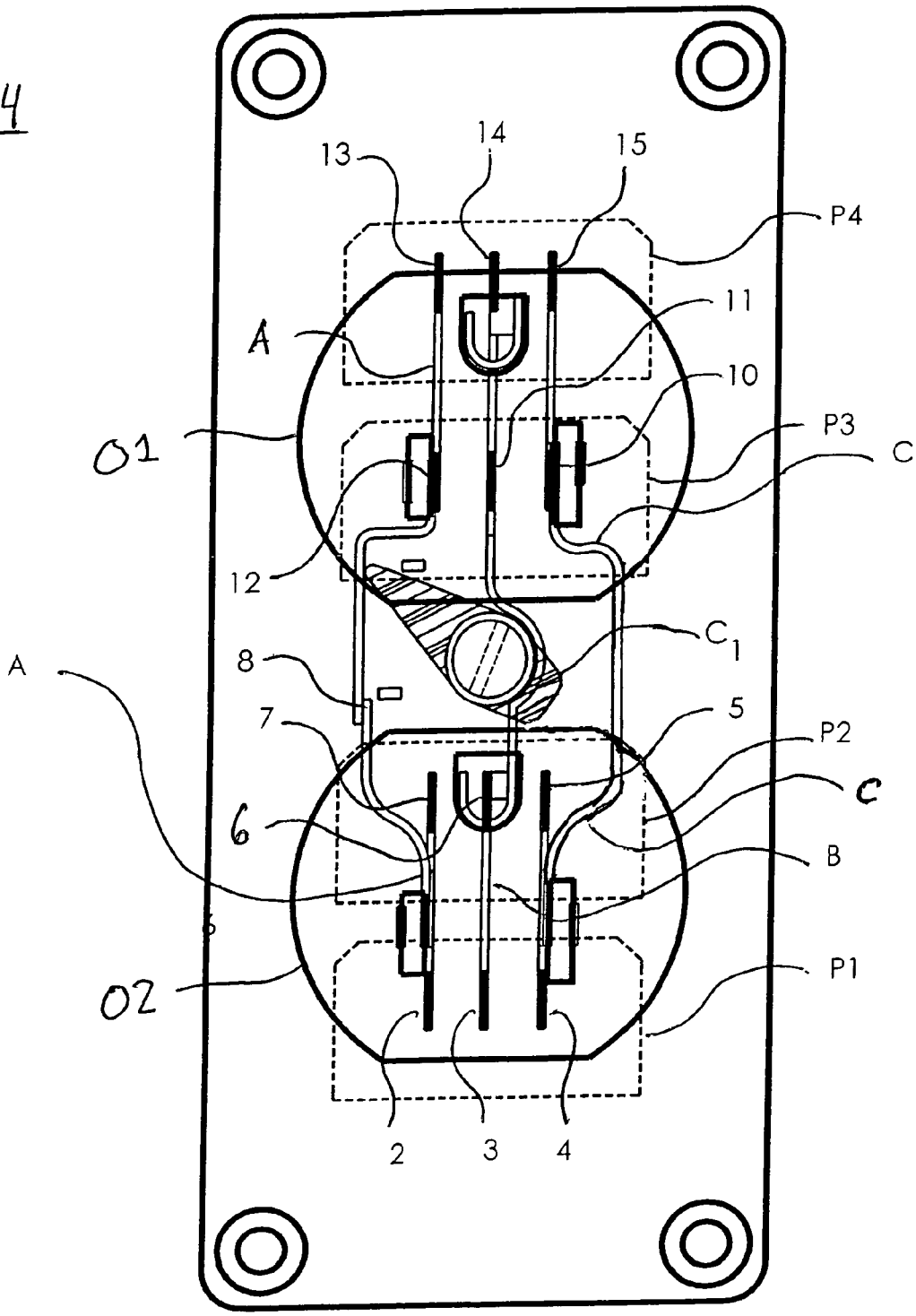
FIG. 4 is a front plan view of the duplex receptacle of the present invention showing the outlets, the bussing and the cam in a first position.
Figure 5:
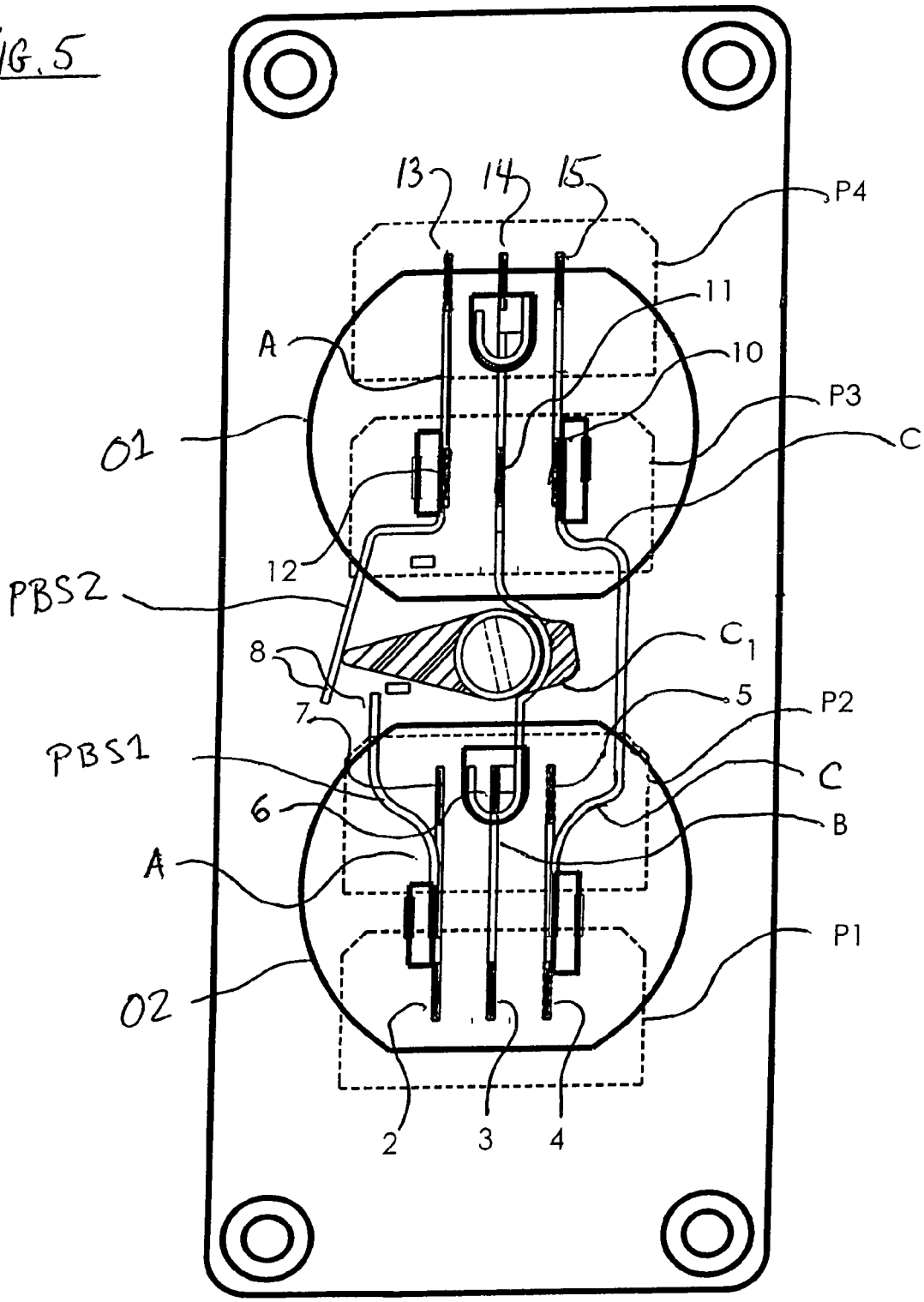
FIG. 5 is a front plan view of the duplex receptacle of the present invention showing the outlets, the bussing and the cam in a second position.

Application 1: As previously stated, FIG. 1 is the electrical wiring schematic for this circuit. The electric current or power (100) is brought in to either end of a receptacle (200). In our case and for this application the power can be brought in at any port P1, P2, P3, or P4, FIG. 3, and taken out of any port and to the next receptacle (201). In FIG. 4, we will follow the current with cam C1, set as shown. The current will enter port P1 at point 2 and travel through A bus to point 8 and out at either points 12 or 13 to the next receptacle. This is duplicated to as many receptacles as needed or allowed according to the National Electric Code. The current then returns via the white or neutral wire at port P4, point 15, travels through bus C and on to points 5 and 4, out of port P1, and back to the panel to complete the "loop".

Application 2: In this circuit, shown in FIG. 2, a switch (102) is wired in conjunction with the duplex receptacle so that it can control part or half of the receptacle (200), namely outlet O2. Looking at FIG. 2 and FIG. 5, we can follow the current. Power will come into the receptacle into two ports from two sources, a switch and directly from the power panel or another receptacle or a junction box. FIG. 2 shows the top half of the receptacle (203) connected to the power source and always energized. From there it will feed another duplex receptacle (201) and then another (206) if needed. The bottom of the receptacle is connected to a switch (102). This will control that part of the receptacle and anything that is plugged into it. In this circuit we show a floor lamp (101). Examining our receptacle in FIG. 5, we see the cam C1 set in the position shown. The cam C1 is opening the power bus A at point 8 breaking or disconnecting the two outlets O1 and O2. This causes a first power bus segment PBS1 and a second power bus segment PBS2 to be electrically separated. The current will travel through the hot (black) wire and into port P4 at 13 by way of the Q-CEB connector allowing the top half to be always energized and leaving through port P3 to feed the next receptacle and then to other receptacles. Current then travels back through the receptacles via the neutral (white) entering at port P3 point 12 and to 15 and back to the source, completing the circuit or "loop". The current coming from the switch will enter port P1 at point 2, and energizing that part of the receptacle only when the switch is on. If application warrants it, the circuit may have another receptacle also connected to the switch. This is done simply by the use of another Q-CEB connector plugged into port P2. The current would come through point 2 as stated and now leave at point 7, through the connector and onto the other receptacle. The return trip will be such that the current will enter port P2 point 5 to point 4 and back to the switch completing the circuit. The ground wire in every electrical circuit is connected to the equipment ground in the power panel and runs directly through any electrical device. In conventional wiring, the ground is attached to a ground screw on the device for safety precautions because of exposed metal parts on the devices. Our wiring devices will have no exposed metal parts and all metal will be completely enclosed. Therefore, the ground wire will be connected in the Q-CEB connector, making connection to the port where it is plugged into and to the B buss. The ground bus B is terminated at points 3, 6, 11, 14 and at the ground terminal in each outlet in our receptacle. This will tie the ground through the complete circuit and back to the panel.

Figure 6:
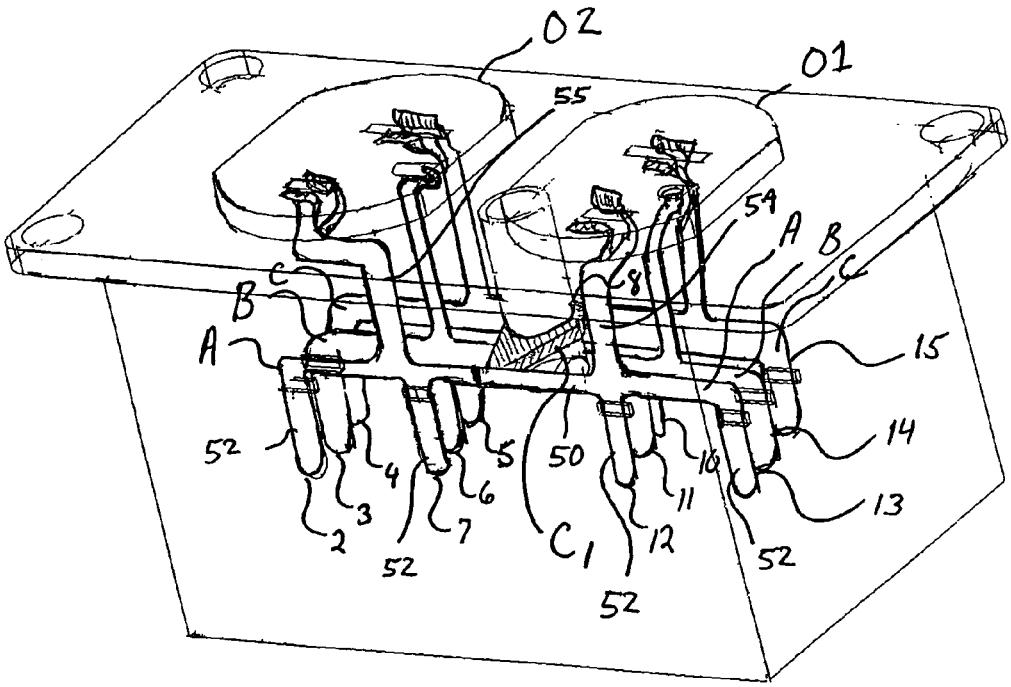
FIG. 6 is a perspective view the duplex receptacle of the present invention.

As best shown in FIG. 6 power bus A, the ground bus B and the return bus C each further comprise a longitudinally extending portion 50, four leg portions 52 with one leg portion extending to of each said ports (P1, P2, P3 and P4), and two neck portions 54, 55 with one neck portion 54 extending to said first outlet O1 and a second neck portion 55 extending to said second outlet O2. The drawings on FIG. 7 show different views of the duplex receptacle of the present invention.

It is to be understood that while certain forms of the present invention have been illustrated and described herein, the present invention is not to be limited to the specific forms or arrangements of parts described and shown.

We claim:

1. A duplex receptacle for electric cable wiring comprising:

a) an enclosure having input ports and an output ports;

b) a first electrical outlet;

c) a second electrical outlet;

d) power buses extending in segments between said input ports and said output ports, each of said power buses having a first power bus segment connected to said first outlet and a second power bus segment connected to said second outlet;

e) a return bus extending between one of said input ports and said output ports, said return bus connected to said first outlet and to said second outlet;

f) a ground bus extending between one of said input ports and said output ports, said ground bus connected to said first outlet and to said second outlet; and g) a cam having a cam arm, said cam movable between a first position and a second position wherein, in said first position, said arm does not contact said power bus and said first power bus segment is in electrical contact with said second power bus segment and, in said second position, said arm contacts said power bus and causes said first power bus segment and a second power bus segment to be electrically separated;

wherein said input ports and said output ports each provide a separate and independent connection to said power bus, said return bus and said ground bus.

2. A duplex receptacle according to claim 1 wherein said enclosure has an exterior and said input ports and said output ports are accessible from the exterior of the enclosure.

3. A duplex receptacle according to claim 1 wherein four ports are provided on said enclosure with each of said ports capable of being connected to an electrical circuit and operating as one of an input port and an output port.

4. A duplex receptacle according to claim 3 wherein said power bus and said return bus each further comprise a longitudinally extending portion, four leg portions with one leg portion extending to of each said ports and two neck portions with one neck portion extending to said first outlet and a second neck portion extending to said second outlet.

5. A duplex receptacle according to claim 1 wherein said cam has a shaft adapted for rotation between said first position and said second position.

6. A duplex receptacle according to claim 1 wherein said cam has a shaft which extends at least partially through an exterior of the enclosure and can be rotated between said first position and said second position from a location outside the enclosure.

7. A duplex receptacle according to claim 1 wherein said enclosure is factory sealed and has an interior which is inaccessible to an installer.

* * * * *